US007303016B2

(12) United States Patent
Kristiansen

(10) Patent No.: US 7,303,016 B2
(45) Date of Patent: Dec. 4, 2007

(54) CASING WITH ISOLATED ANNULAR SPACE

(76) Inventor: Einar Kristiansen, Sandsloen 55, Stavanger (NO) N-4022

( * ) Notice: Subject to any disclaimer, the term of this patent is extended or adjusted under 35 U.S.C. 154(b) by 29 days.

(21) Appl. No.: 10/539,676

(22) PCT Filed: Dec. 15, 2003

(86) PCT No.: PCT/NO03/00418

§ 371 (c)(1),
(2), (4) Date: Jun. 16, 2005

(87) PCT Pub. No.: WO2004/097155

PCT Pub. Date: Nov. 11, 2004

(65) Prior Publication Data

US 2006/0048935 A1 Mar. 9, 2006

(30) Foreign Application Priority Data

Dec. 16, 2002 (NO) ..... 20026025

(51) Int. Cl.
*E21B 17/00* (2006.01)

(52) U.S. Cl. ..... 166/297; 166/242.1; 166/162; 166/55.1

(58) Field of Classification Search ..... 166/242.3, 166/115, 163, 166, 169, 297, 55.1, 162, 242.1; 138/112, 113, 114, 148
See application file for complete search history.

(56) References Cited

U.S. PATENT DOCUMENTS

| | | | | |
|---|---|---|---|---|
| 2,468,902 | A * | 5/1949 | Villiger | 138/114 |
| 3,155,117 | A * | 11/1964 | Spillmann | 138/149 |
| 3,511,282 | A * | 5/1970 | Martin et al. | 138/113 |
| 5,318,128 | A * | 6/1994 | Johnson et al. | 166/312 |
| 5,551,513 | A | 9/1996 | Surles et al. | |
| 5,595,245 | A | 1/1997 | Scott, III | |
| 6,116,343 | A | 9/2000 | Petegem et al. | |
| 2002/0112854 | A1 * | 8/2002 | Krueger et al. | 166/250.07 |
| 2002/0185313 | A1 * | 12/2002 | Jones et al. | 175/48 |

* cited by examiner

*Primary Examiner*—William Neuder
*Assistant Examiner*—Nicole A Coy
(74) *Attorney, Agent, or Firm*—Andrus, Sceales, Starke & Sawall, LLP

(57) ABSTRACT

The invention is comprised of (see FIG. 1) an inner pipe (2), and an outer pipe (3), and two end subs (1). An isolated circular hollowed space is contained in between these components. The isolated space can be used for transport of different medias down into the well, this can be vacuum, air, gas, acids, solids, tracers, or other well stimulating medias. The end subs (1) can be connected to the casing in the well and become an integrated part of the casing. The invention can be cemented on the outside like the casing can. The invention can be perforated after installed in the well.

4 Claims, 2 Drawing Sheets

1b-1b 2b-2b

CASING WITH ISOLATED ANNULAR SPACE

CROSS REFERENCE TO RELATED APPLICATION

The present application is the U.S. national stage application of International Application PCT/NO2003/000418, filed Dec. 15, 2003, which international application was published on Nov. 11, 2004 as International Publication WO 2004/097155. The International Application claims priority of Norwegian Patent Application 20026025, filed Dec. 16, 2002.

BACKGROUND AND SUMMARY OF THE INVENTION

The invention is related to a casing with isolated annular space. The invention can be applied in wells that are drilled for production of hydrocarbons. The invention can be installed and used as an integrated part of the casing that is penetrating a reservoir, or a zone in the well that shall perforated.

Wells that are drilled in conjunction with production of hydrocarbons are drilled in sections, starting with the biggest diameter at the top. Normally, a casing is installed in each section after the hole is drilled. Each casing is normally cemented in place. The deepest section in the well will normally penetrate the zone of interest, which is the reservoir that will produce hydrocarbons, or the zone that it is planned for injection of water or gas. A casing will also normally be installed and cemented in place across the zone of interest.

Communication between the reservoir and the well bore is normally obtained by the use of perforating guns. The perforating guns are normally tubular loaded with many explosive charges that is shooting radial holes through the casing and cement and several feet into the reservoir rock. All charges are detonated at the same time.

One of the challenges related to the perforating technology is to remove the perforating debris from the perforating tunnels after the perforating operation. Debris left in tunnels will lead to excess fluid friction during production that could lead to lower production rate as a result.

One effective method for cleaning the perforating tunnels to perforate in "under balance". This is done by changing out the well bore fluid with a low density fluid to lower the well bore pressure to a level that is lower than the pressure in the reservoir prior to perforating. This pressure differential between the reservoir and the well bore will lead to an immediately flow of fluid into the well when the casing is perforated. The result is a relatively high flow rate that will clean the perforating tunnels.

There are methods available today for achieving similar cleaning effects without having to lower the well bore pressure. One method is to use atmospheric chambers in the perforating guns that also are perforated at the same time as the casing. The chambers will fill immediately due to the relatively high hydrostatic pressure. The filling of the atmospheric chambers will create an "under balance" in the well that will give similar cleaning effect as obtained by changing out the well bore fluid.

This invention is based on using atmospheric chambers. The difference from the described methods is that chambers are an integrated part of the casing. The chambers are penetrated and punctured when perforating the casing. This is described in claim # 1 in this application.

BRIEF DESCRIPTION OF THE DRAWINGS

The invention is described in following figures.

DETAILED DESCRIPTION OF THE INVENTION

Figure 1A:
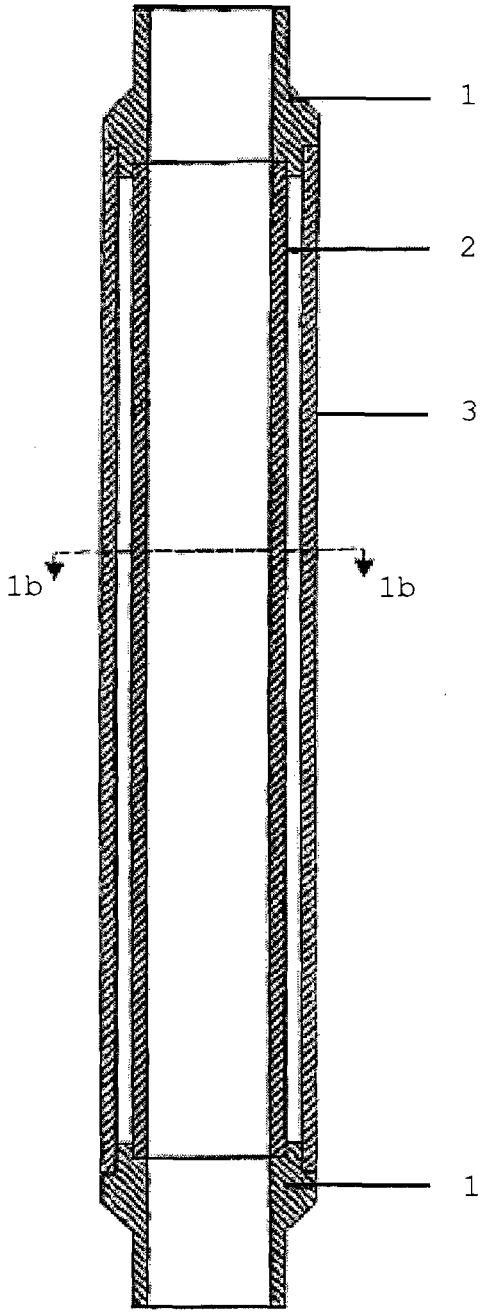
FIG. 1*a* shows a longitudinal cut of a preferable way of designing the invention, consisting of an inner pipe (casing) and an outer pipe (casing) that is connected by two end subs.
Figure 1B:
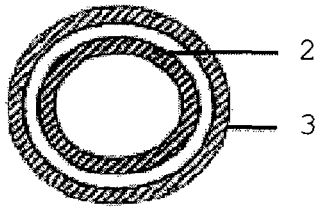
FIG. 1*b* shows a cut of a preferable way of designing the invention.
Figure 2A:
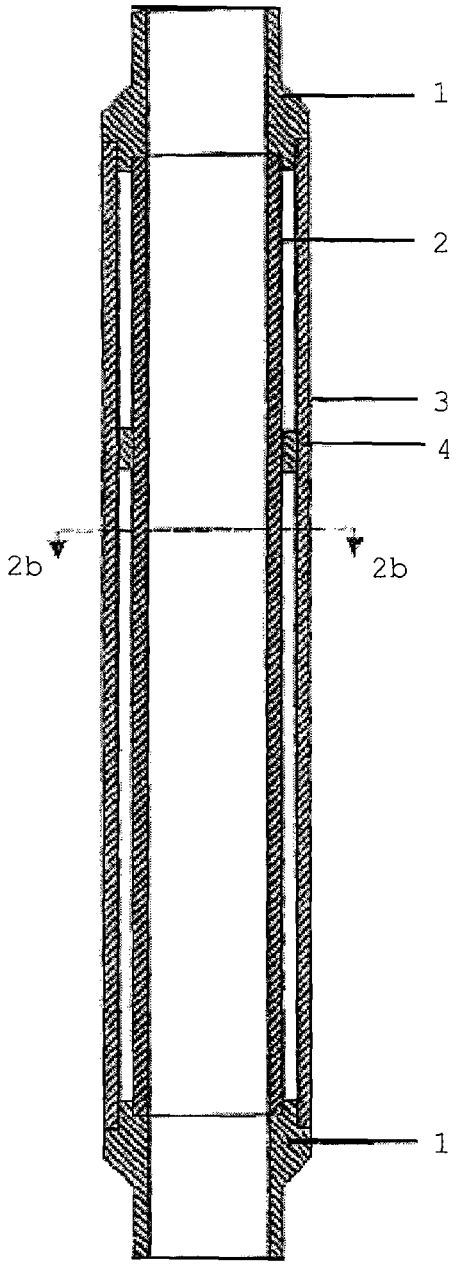
FIG. 2*a* shows a longitudinal cut of an alternative way of designing the invention, with support rings between inner pie and outer pipe.
Figure 2B:
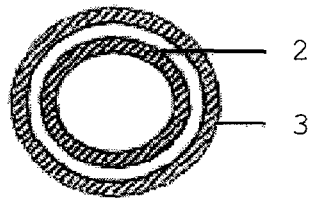
FIG. 2*b* shows a cut of an alternative way of designing the invention.

The invention consists of an inner pipe (1,2), and an outer pipe (1,3), and two end subs (1,1). In between these components there is an isolated, circular space that can be used for transport of different media into the well, this can be vacuum, air, gas, different solids, acids, tracers, or other well stimulating medias. If the invention is exposed to high collapse forces during the installation, support rings (2,4) can be installed. The end subs can be connected to the casing in the well such as the invention becomes an integrated part of the casing. As the invention is a part of the casing, it can also be cemented in place on the outside in the same way as for the casing.

One challenge in the perforating technology is to clean out perforating debris from the perforation tunnels.

This invention can help clean out or stimulate the perforating tunnels immediately after the perforating.

The perforating gun shoots from inside the invention, through the invention, and out into the formation/reservoir that is on the outside of the invention. The invention therefore is punctured. If the isolated space is filled with air or gas that has a lower pressure than the formation, the space will immediately fill up with fluid from the formation. This immediately filling will give a washing effect in the perforating tunnels.

If the isolated space is filled with an acid that reacts with the reservoir rock or perforating debris, the acid could flow into the perforating tunnels and give a stimulating effect immediately after perforating if the pressure in the well bore is higher than in the reservoir.

The invention claimed is:

1. A method of perforating a well that extends into a surrounding formation, the method comprising the steps of:

permanently installing a casing in the well, a portion of the casing comprising an inner pipe, an outer pipe, and two end subs disposed at each end portion of the inner and outer pipes;

wherein the inner pipe, outer pipe, and end subs define an integrated annular space that encloses a well stimulating medium, the well stimulated medium having a pressure that is lower than the pressure of the surrounding formation; and perforating the inner pipe and outer pipe to form a communication pathway between the integrated annular space and the surrounding formation and such that the pressure differential between the well stimulating medium and the surrounding formation causes the removal of perforating debris from the communication pathway.

2. A method of communicating a well stimulating medium contained in an annular space integrated in a portion of a casing permanently installed in a well, the annular space being defined by an inner pipe, an outer pipe and two end subs disposed at each end portion of said inner pipe and outer pipe, the method comprising the step of communicating the well stimulating medium with a formation surrounding the casing by simultaneous perforation of said inner pipe and outer pipe.

3. The method according to claim 2, wherein the annular space is filled with a fluid having a pressure substantially lower than the pressure in the formation surrounding the casing, whereby parts of the perforating debris will flow from the formation and into the perforated annular space.

4. The method according to claim 2, wherein the well stimulating medium comprises a vacuum, whereby parts of the perforating debris will be sucked into the perforated annular space upon perforating said annular space.

* * * * *